US007552750B2

(12) United States Patent
Miller et al.

(10) Patent No.: US 7,552,750 B2
(45) Date of Patent: Jun. 30, 2009

(54) METHOD AND APPARATUS FOR CUTTING VENEER SHEETS FROM A FLITCH

(75) Inventors: Thomas A. Miller, Indianapolis, IN (US); Robert D. Brand, Indianapolis, IN (US)

(73) Assignee: Miller Veneers, Inc., Indianapolis, IN (US)

( * ) Notice: Subject to any disclaimer, the term of this patent is extended or adjusted under 35 U.S.C. 154(b) by 24 days.

(21) Appl. No.: 11/107,026

(22) Filed: Apr. 15, 2005

(65) Prior Publication Data

US 2005/0230004 A1 Oct. 20, 2005

Related U.S. Application Data

(60) Provisional application No. 60/562,380, filed on Apr. 15, 2004.

(51) Int. Cl.
*B27C 1/00* (2006.01)

(52) U.S. Cl. ..... 144/177; 144/178; 144/214; 144/363; 144/369

(58) Field of Classification Search ..... 144/209.1, 144/214, 215.2, 162.1, 178, 179, 211, 359, 144/363, 365, 369, 177
See application file for complete search history.

(56) References Cited

U.S. PATENT DOCUMENTS

| | | | | |
|---|---|---|---|---|
| 793,306 | A | 6/1905 | Koss | |
| 2,576,520 | A | 11/1951 | Koss | |
| 2,676,627 | A | 4/1954 | McFall | |
| 3,441,069 | A | 4/1969 | Koss | |
| 3,603,362 | A * | 9/1971 | Neild | 269/54.2 |
| 3,654,973 | A | 4/1972 | Koss | |
| 3,680,612 | A | 8/1972 | Hale | |
| 3,808,925 | A | 5/1974 | Hards | |
| 3,905,408 | A | 9/1975 | Hale | |
| 4,068,693 | A | 1/1978 | Cremona | |
| 4,069,850 | A | 1/1978 | Cremona | |
| 4,352,488 | A * | 10/1982 | Cremona | 269/54.2 |
| 4,392,519 | A | 7/1983 | Calvert | |
| 4,503,896 | A | 3/1985 | Brand | |
| 4,587,616 | A | 5/1986 | Weil | |
| 4,601,317 | A | 7/1986 | Brand | |
| 4,683,926 | A | 8/1987 | Weil | |
| 5,101,874 | A | 4/1992 | Weil | |
| 5,143,129 | A | 9/1992 | Toivio | |
| 5,150,746 | A | 9/1992 | Weil | |
| 5,333,658 | A | 8/1994 | Albion et al. | |
| 5,381,841 | A | 1/1995 | Weil | |
| 5,385,184 | A | 1/1995 | Mellor | |

(Continued)

FOREIGN PATENT DOCUMENTS

EP 0627285 A2 12/1994

*Primary Examiner*—Bena Miller
(74) *Attorney, Agent, or Firm*—Clifford W. Browning; Krieg DeVault LLP

(57) ABSTRACT

A method and apparatus for retaining a flitch on a staylog or slicer for slicing veneer from the flitch, the staylog or slicer having a plurality of expandable wedge-clamp dogs, the method comprising the steps of providing a flitch having a plurality of dados for receiving a plurality of wedge-clamp dogs, positioning the plurality of wedge-clamp dogs within the plurality of dados in the flitch, and expanding the wedge-clamp dogs to retain the flitch on the staylog or slicer.

14 Claims, 12 Drawing Sheets

U.S. PATENT DOCUMENTS 5,562,137 A 10/1996 Brand
5,694,995 A 12/1997 Brand
5,701,938 A * 12/1997 Brand ..... 144/363
5,819,828 A * 10/1998 Brand ..... 144/365
5,865,232 A 2/1999 Miller et al.
5,996,656 A * 12/1999 Fezer ..... 144/178
7,028,729 B2 * 4/2006 Constantine et al. ..... 144/332
7,100,650 B2 * 9/2006 Heiner et al. ..... 144/214
2005/0241453 A1 * 11/2005 Heiner et al. ..... 83/613

* cited by examiner

METHOD AND APPARATUS FOR CUTTING VENEER SHEETS FROM A FLITCH

This application claims the priority benefit of U.S. Provisional Patent Application Ser. No. 60/562,380, filed Apr. 15, 2004.

The present invention relates to cutting veneer sheets from veneer logs, generally, and more particularly to a novel apparatus for cutting veneer sheets from a flitch (one-half of a veneer log which has been sawn in half longitudinally) that places the veneer producing face of a tapered flitch in a stable, parallel relationship with the veneer slicing knife, thereby allowing full utilization of the natural taper of a veneer log.

BACKGROUND OF THE INVENTION

Preparing logs for veneering begins in the sawmill. This milling process, known as flitching, takes place on either a circular saw or a band saw. Traditionally, the veneer logs have been sawn at the mill to remove the log's natural taper so that the logs are left somewhat squared at the butt end, leaving substantially no taper remaining in the log from top to bottom, as opposed to from side to side, and from the small end to the butt end—substantially all the taper from the top to the bottom having been removed from the butt end of the log. See FIGS. 1 and 2. This squaring up process results in the removal of valuable veneer wood from the butt end of the veneer log. The squared up veneer log is then sawn in half lengthwise, and two flitches are thereby produced. The two flitches may or may not be of the same thickness, but each squared up flitch will hold substantially the same longitudinal thickness from top to bottom from its small end to its butt end. See FIG. 2.

Fifty or more flitches are placed in a vat of water at a veneer mill to be heated in preparation for slicing. They are then extracted, a few at a time, and mounted one at a time on the rotary-staylog of a conventional rotary-staylog veneer slicing machine by any number of conventional dogging (attachment) systems. The typical rotary-staylog has a cast steel body that extends the length of the cutting surface of a veneer slicing knife. The rotary-staylog body is fixed between the lathe centers of the head stock and the tail stock of the machine and rotates between them, as would a woodturning in a conventional lathe. Presently, the preferred dogging systems in use to attach a squared up flitch to a conventional rotary-staylog veneer slicing machine require that at least two parallel grooves be cut into the flat underside of the flitch (FIG. 2), each of a sufficient size to receive a plurality of pairs of hydraulically driven clamping dogs that are spaced along the entire length of and extend about 1 inch above the mounting surface of the rotary-staylog. The pairs of clamping dogs engage the flitch within the grooves when the flitch is laid flush upon the mounting surface of the rotary-staylog and pinch the flitch between the grooves to secure the flitch to the rotary-staylog.

The presence of grooves cut into the flat underside of the flitch results in a weakening of the edges of the flitch as the size of the flitch is reduced by the slicing of veneer sheets from the flitch as it rotates on the rotary-staylog. Eventually, a springing action occurs under the hydraulic force of the clamping dogs and the veneer slicing knife as a result of the thinning of the wood between the grooves and the face of the flitch from which the veneer is being removed. This produces "shim sheets" or sheets of veneer with edge thicknesses that taper away to nothing, as opposed to sheets that maintain a consistent thickness across the entire width of the sheets. The inclusion of the "shim sheets" with the otherwise saleable veneer will result in customer dissatisfaction because these sheets will result in the rejection of veneer faces that include these thinner than allowable or "shim sheets." It is presently considered to be good practice to discard these "shim sheets" as they come off the rotary-staylog, which results in less product, lower yields, poor resource use, and less profit for the veneer mill.

It is common practice for veneer mills to plane the underside of the flitch prior to or during the grooving procedure to achieve a perfectly flat and hence more stable surface to attach, or dog, the squared up flitch to conventional rotary-staylog, it being believed that a more stable cut will be the result. This, however, requires the loss of even more material from the squared up flitch and results in less of the flitch being reduced into usable veneer. The shimming problem still occurs as before, for the wood still springs as the grooves approach the face of the flitch from which the veneer is being removed. In addition, the most modern dogging systems in use (that still require grooving) leave an unsliceable flitch core of approximately 1 inch thickness at the core's thickest point.

SUMMARY OF THE INVENTION

A novel method and apparatus is provided for retaining a flitch on the staylog of a veneer slicing machine with the outer surface and veneer producing zone of the tapered flitch substantially parallel to the veneer slicing knife. The novel method and apparatus for retaining a flitch on the staylog of a veneer slicing machine of the present invention comprises a novel staylog having seven inch radius wedge-clamps at nine inch centers along the length of the staylog, each wedge-clamp including a wedge, which when hydraulically activated causes a right and left hand clamp plate to expand, thereby securing the flitch to the staylog. A flitch is processed prior to mounting on the novel staylog of the present invention to include a plurality of dados for receiving the wedge-clamps. The dados in the flitch are cut deeper in the thicker butt end of the tapered flitch and more shallow in the thinner end of the tapered flitch, with all the dados in the tapered flitch terminating at substantially the same distance from the outer veneer producing surface of the flitch, thereby cooperating to define a place upon which the tapered flitch rests that places the outer surface and veneer producing zone of the flitch substantially parallel to the veneer slicing knife.

The present invention is not limited to use on rotary staylogs of rotary-staylog veneer slicing machines, but may also be incorporated into a vertical reciprocating slicer.

One embodiment of the present invention is a method for retaining a flitch on a staylog for slicing veneer from the flitch, the staylog having a plurality of expandable wedge-clamp dogs, comprising the steps of providing a flitch having a plurality of dados for receiving a plurality of wedge-clamp dogs; positioning the plurality of wedge-clamp dogs within the plurality of dados in the flitch; and expanding the wedge-clamp dogs to retain the flitch on the staylog.

Another embodiment of the present invention is a method of retaining a flitch on a staylog for slicing the veneer from the flitch, the staylog having a plurality of wedge-clamp dogs, comprising the steps of providing a flitch having a plurality of dados for receiving the plurality of wedge-clamp dogs, the holes having a depth profile and the wedge-clamp dogs having flitch engaging portions configured to generally conform to the depth profile; positioning the plurality of wedge-clamp dogs in the plurality of dados; and engaging the flitch with the wedge-clamp dogs to retain the flitch on the staylog with a veneer producing zone maintained in parallel relation to a veneer slicing knife.

Another embodiment of the present invention is an apparatus for retaining a flitch with a tapered veneer producing face on the mounting surface of a staylog for movement past a veneer slicing knife, comprising wedge-clamp dogs extending from the mounting surface of the staylog for engaging the flitch, and means for expanding the wedge-clamp dogs when engaged with the flitch to hold the flitch on the staylog with the tapered veneer producing face of the flitch in a parallel relationship with the veneer slicing knife so as to minimize the amount of waste veneer taken from the tapered veneer producing face of the flitch.

Another embodiment of the present invention is an apparatus for retaining a flitch on a staylog, the flitch including a plurality of dados formed in the flat underside surface thereof, comprising: a staylog for carrying the flitch; a plurality a wedge-clamp dogs attached to the staylog and positioned to be received by the plurality of dados formed in the flat underside of the flitch for engaging the flitch, and means for expanding the wedge-clamp dogs when engaged with the flitch to hold the flitch on the staylog.

Another embodiment of the present invention is an apparatus for retaining a flitch for slicing, comprising: a staylog having a mounting surface with a plurality of predetermined positions, and a plurality of wedge-clamp dogs located at the predetermined positions for engaging the flitch to retain the flitch on the staylog, wherein the distance between the mounting surface and the flitch at a predetermined position is proportional to the thickness of the flitch at the predetermined position.

Another embodiment of the present invention is a dogging device for retaining a flitch for cutting, comprising: pairs of clamp plates for engaging the flitch having T-bolts as their means of attachment to the staylog which allow the clamp plates to be moveably engageable with a staylog when a hydraulically driven wedge is thrust between the paired clamp plates causing the clamp plates to expand outwardly and thus engage the shoulders of the provided dado and thereby hold the flitch on the staylog.

Another embodiment of the present invention is a method for retaining a flitch on a vertical reciprocating slicer for slicing veneer from the flitch, the slicer having a plurality of expandable wedge-clamp dogs, comprising the steps of providing a flitch having a plurality of dados for receiving a plurality of wedge-clamp dogs; positioning the plurality of wedge-clamp dogs within the plurality of dados in the flitch; and expanding the wedge-clamp dogs to retain the flitch on the slicer.

Another embodiment of the present invention is a method of retaining a flitch on a vertical reciprocating slicer for slicing veneer from the flitch, the slicer having a plurality of wedge-clamp dogs, comprising the steps of providing a flitch having a plurality of dados for receiving the plurality of wedge-clamp dogs, the holes having a depth profile and the wedge-clamp dogs having flitch engaging portions configured to generally conform to the depth profile; positioning the plurality of wedge-clamp dogs in the plurality of dados; and engaging the flitch with the wedge-clamp dogs to retain the flitch on the slicer with a veneer producing zone maintained in parallel relation to a veneer slicing knife.

Another embodiment of the present invention is an apparatus for retaining a flitch on a vertical reciprocating slicer, the flitch including a plurality of dados formed in the flat underside surface thereof, comprising a slicer for carrying the flitch; a plurality of wedge-clamp dogs attached to the slicer and positioned to be received by the plurality of dados formed in the flat underside of the flitch for engaging the flitch, and means for expanding the wedge-clamp dogs when engaged with the flitch to hold the flitch on the slicer.

Another embodiment of the present invention is an apparatus for retaining a flitch for slicing, comprising a vertical reciprocating slicer having a mounting surface with a plurality of predetermined positions, and a plurality of wedge-clamp dogs located at the predetermined positions for engaging the flitch to retain the flitch on the staylog, wherein the distance between the mounting surface and the flitch at a predetermined position is proportional to the thickness of the flitch at the predetermined position.

Another embodiment of the present invention is a dog for retaining a flitch for cutting, comprising a pair of clamp plates for engaging the flitch, each having a T-bolt that is moveably engageable with a vertical reciprocating slicer; and means for expanding the pair of clamp plates to engage the flitch to hold the flitch on a slicer.

It is a principal object of the present invention to provide a novel method and apparatus for cutting veneer sheets from a flitch that includes attaching a naturally tapered flitch to a staylog or vertical reciprocating slicer such that the veneer producing face of the naturally tapered flitch is placed in a stable, parallel relationship with the veneer slicing knife, thereby allowing full utilization of the natural taper of a veneer log from nearly the first cut of the veneer slicing knife, which results in superior veneer cuts, more consistent thicknesses of the resulting veneer sheets, no shimming out on the veneer sheets, and a much higher yield due to more of the flitch's outer surface and inner core being cut into veneer sheets.

Related objects and advantages of the method and apparatus for cutting veneer sheets from a flitch of the present invention will be evident from the following description.

BRIEF DESCRIPTION OF THE DRAWING FIGURES

FIG. 1 is a prior art drawing figure.

FIG. 2 is a prior art drawing figure.

DETAILED DESCRIPTION OF THE PREFERRED EMBODIMENTS

For the purposes of promoting an understanding of the principles of the invention, reference will now be made to the preferred embodiments of the invention and specific language will be used to describe the same. It will nevertheless be understood that no limitation of the scope of the invention is thereby intended, as such alterations and further modifications in the described invention, and such further application of the principles of the invention as described therein, are contemplated as would normally occur to one skilled in the art to which the invention relates.

Figure 1:
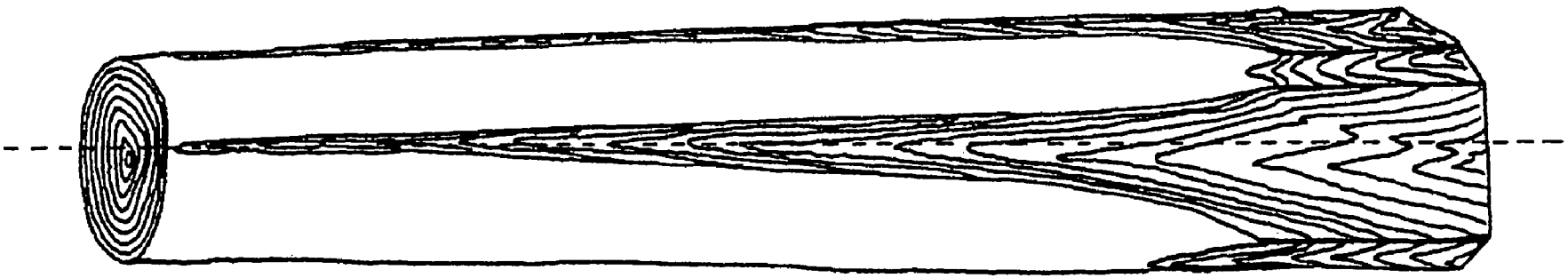
Fig. 1 (Prior Art)
FIG. 1 is a perspective view of a squared up 16 inch veneer log prior to being sawn in two along the dotted lines to create two squared up flitches of the prior art.
Figure 2:
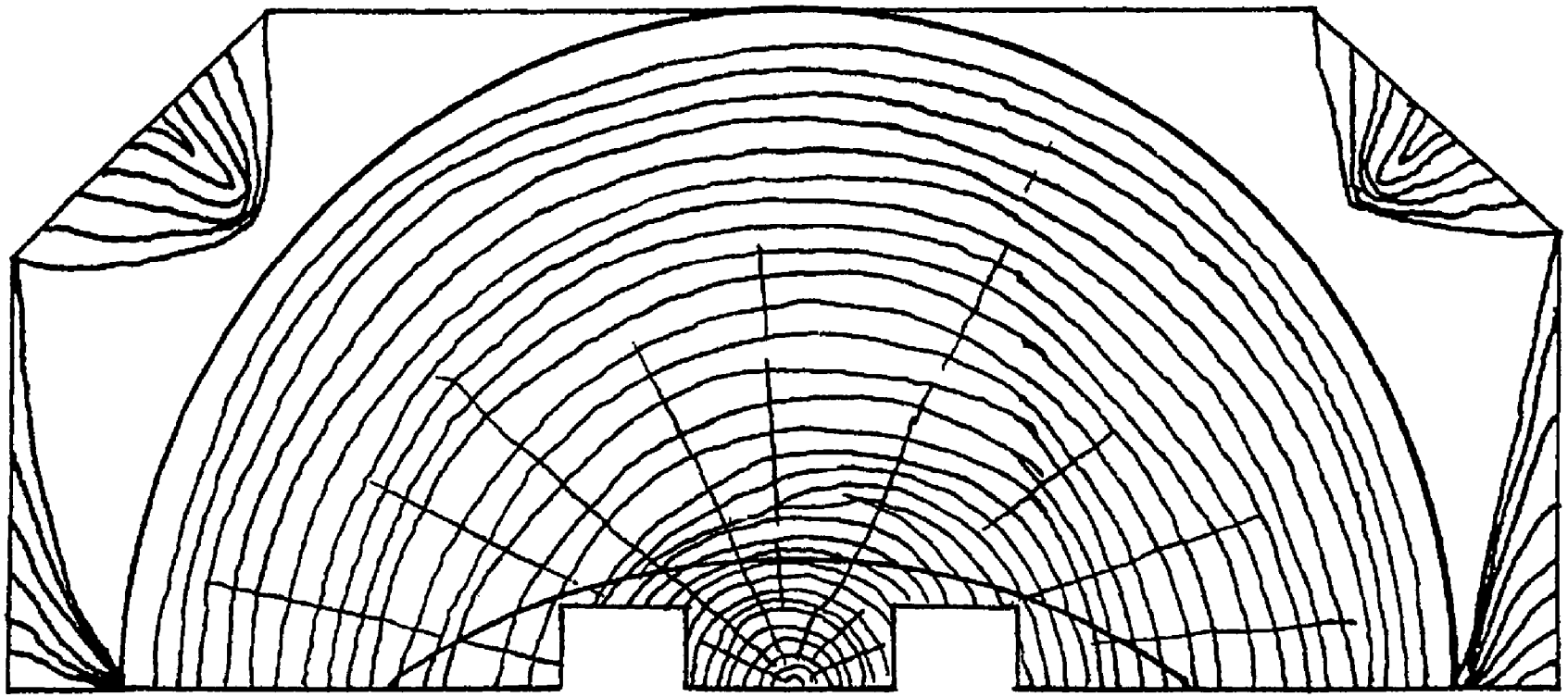
Fig. 2 (Prior Art)
FIG. 2 is an end view of the top end of one of the squared up flitches sawn from the squared up 16 inch veneer log of FIG. 1 that has been grooved for attachment to a conventional rotary-staylog of the prior art.
Figure 3:
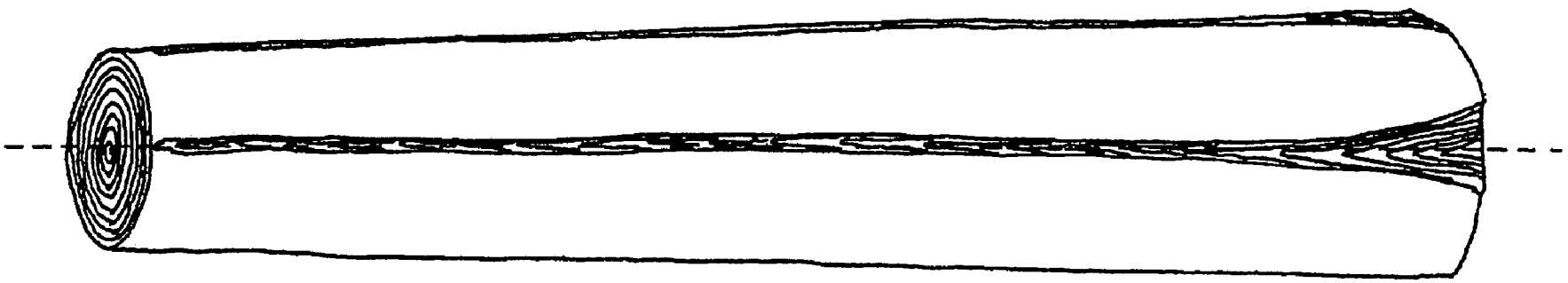
FIG. 3 is a perspective view of a tapered veneer log that has been sawn by keeping just to the outside of the log thereby retaining the natural taper in the log, that will be sawn in half and the resulting flitches used in the method and apparatus of the present invention.
Figure 4:
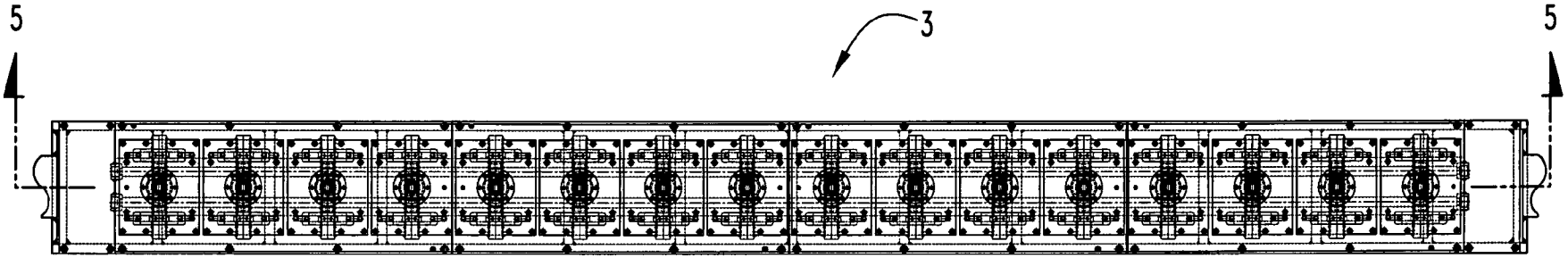
FIG. 4 is a top plan view of a wedge-clamp dogging rotary staylog of the present invention.

The novel method and apparatus for cutting veneer sheets from a flitch of the present invention requires different flitching techniques than those used in the prior art. Rather than removing substantially all of the top to bottom taper from a veneer log in the squaring up process performed in the sawmill, the method and apparatus of the present invention requires a sawyer to just barely engage the veneer log on all four sides and along its entire length—that is, the sawyer keeps to the outside of the log. By so doing, once the log has been faced on all four sides, the veneer log will still retain substantially all its natural taper (see FIG. 3). When the tapered veneer log is then sawn in half lengthwise to create two flitches, neither flitch holds the same thickness from end to end—each flitch retains its natural taper. The amount of taper in the flitches will vary from species to species, with the greatest taper occurring in the sun-loving, more open grown species, such as walnut and white oak, and the least taper occurring in the deep woods species, such as red oak and cherry.

The most preferred apparatus to date for putting into practice the novel method of the present invention for attaching a naturally tapered flitch to a rotary staylog such that the veneer producing face of the naturally tapered flitch is placed in a stable, parallel relationship with the veneer slicing knife is the apparatus hereinafter referred to as the wedge-clamp rotary staylog (3) which is illustrated in FIGS. 4-7 with dovetail ends mounted thereon that correspond to the end spindles of the lathe to which the staylog will be mounted. The wedge-clamp rotary staylog (3) differs significantly from the rotary staylogs of the prior art in the manner in which it secures a tapered flitch to the staylog. The wedge-clamp rotary staylog (3) of the present invention requires reworking of the conventional rotary staylog as follows.

Figure 6:
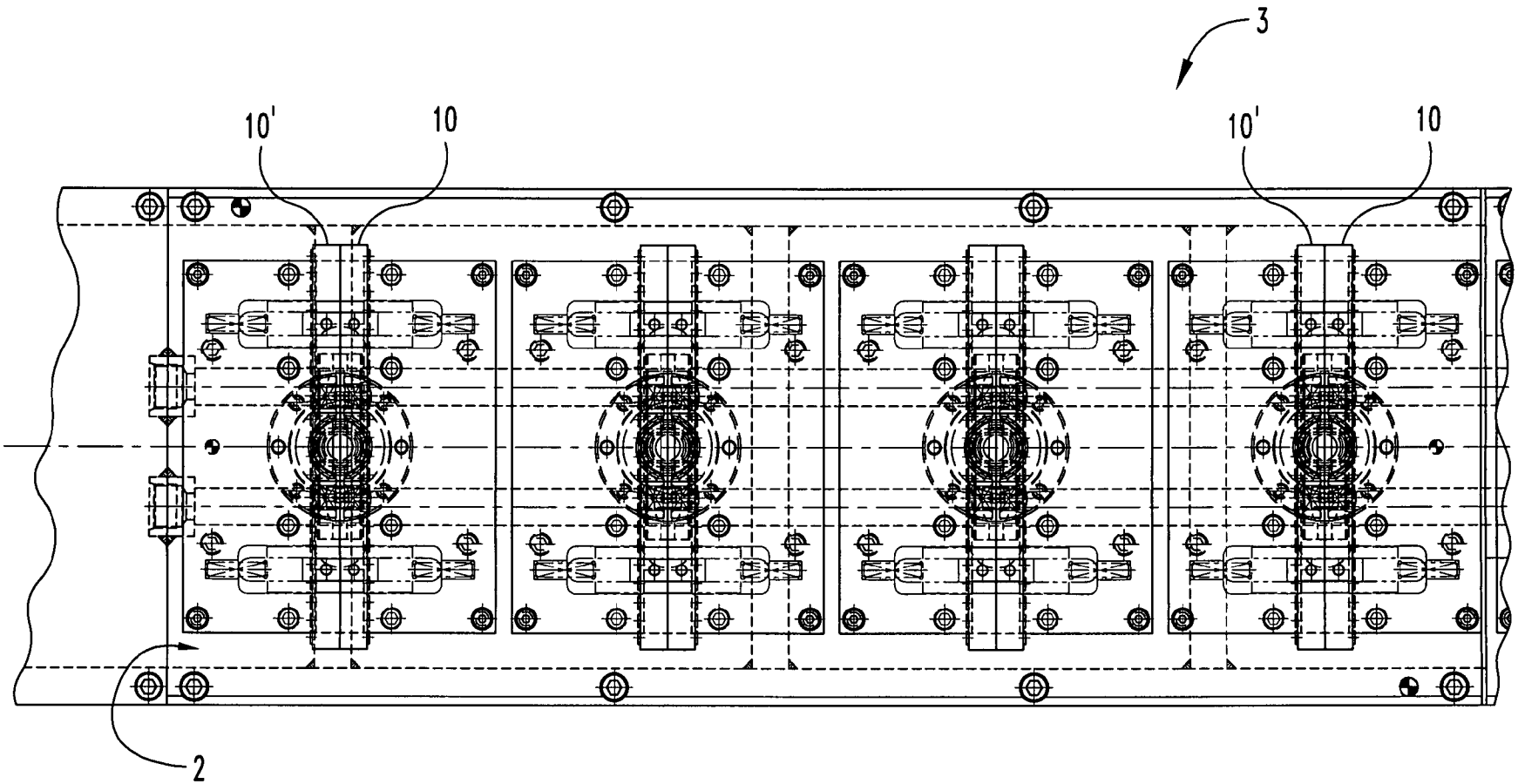
FIG. 6 is an enlarged sectional top plan view of the wedge-clamp dogging rotary staylog of FIG. 4.
Figure 7:
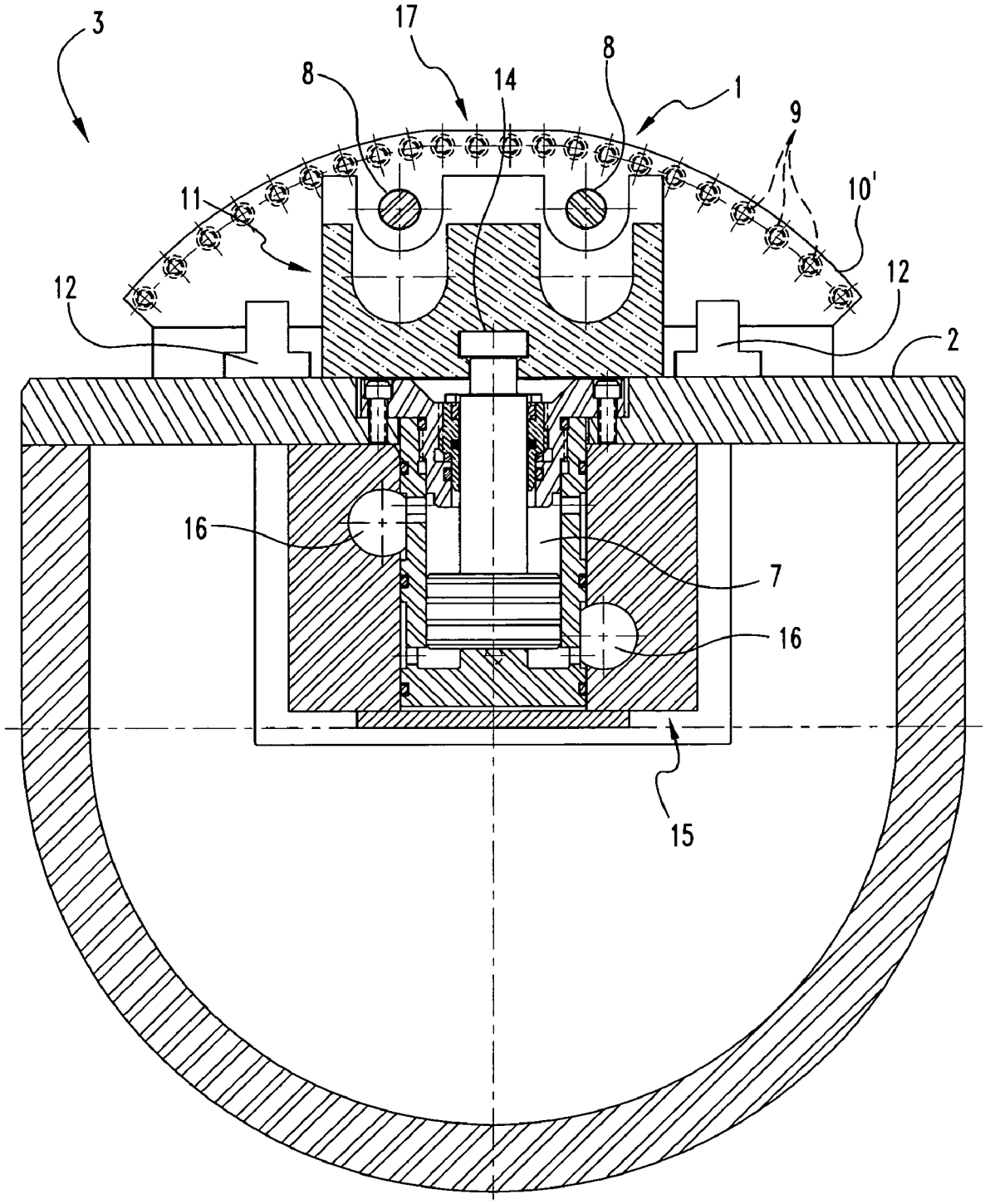
FIG. 7 is an enlarged sectional end view of the wedge-clamp dogging rotary staylog of FIG. 4 taken along line 7-7.

Referring now to the drawings, the dogs of the novel wedge-clamp rotary staylog (3) of the present invention for attaching a flitch to the staylog are hydraulically actuated wedge-clamp dogs (10, 10') that extend approximately 3 inches above the mounting surface (2) of the rotary staylog (3), as compared to the dogging clamps of the prior art that project a mere 1 inch or less above the mounting surfaces of the staylogs of the prior art. Referring now to FIGS. 6-7, in the preferred embodiment to date of the wedge-clamp rotary staylog (3) of the present invention, wedge-clamp dogs (1) are arranged at nine inch intervals along the full length of the mounting surface of the rotary staylog (2). The wedge-clamp dogs (1) are sized to be inserted into corresponding dados that have been dadoed into the flat underside of the tapered flitch while it is being processed for mounting on the staylog (3). The depths of the dados are selectively sized such that the top end of each of the wedge-clamp dogs (1) makes contact with the bottom of the corresponding dado in the tapered flitch when the tapered flitch is lowered onto the rotary-staylog (3).

Figure 16:
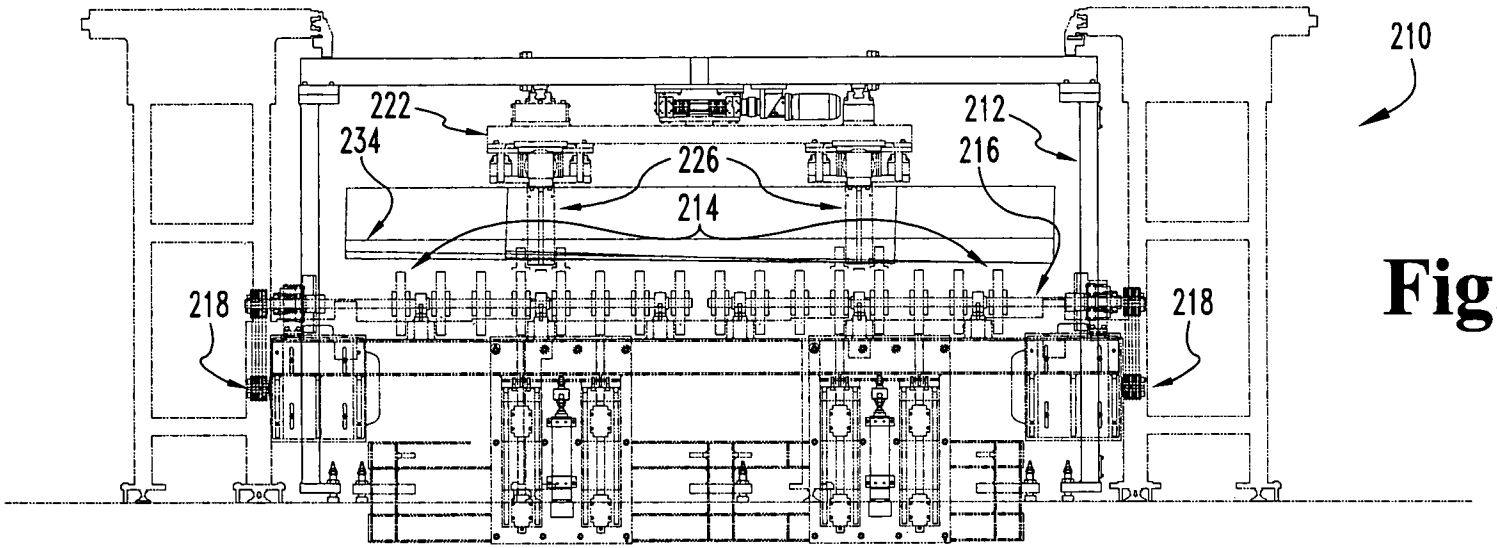
FIG. 16 is a left side view of a typical dado machine.
Figure 17:
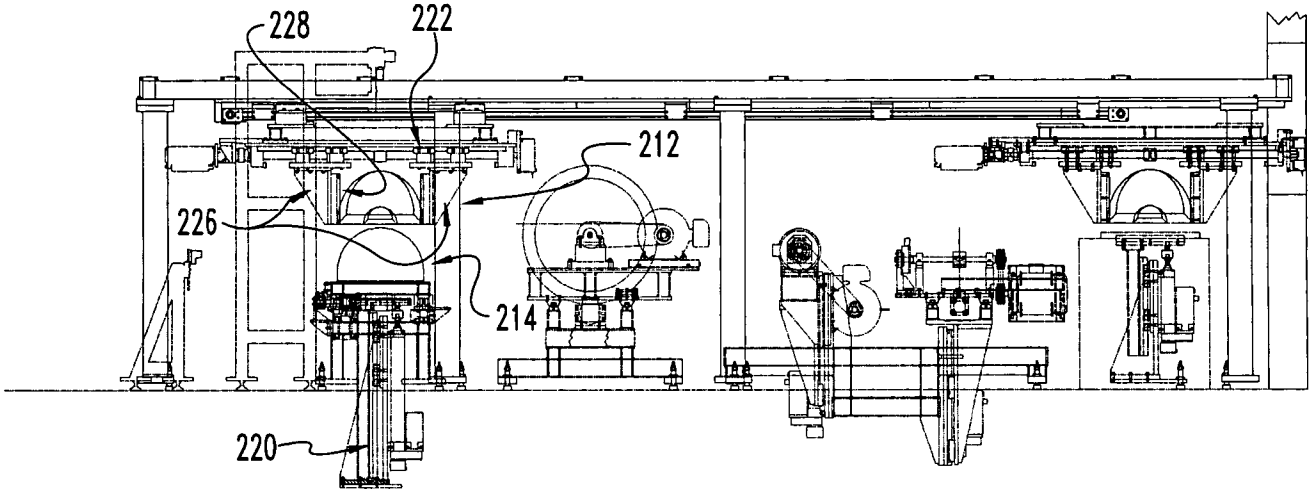
FIG. 17 is a right end view of FIG. 16.

To further explain this important aspect of the present invention, the dados to be dadoed into the flat underside of the tapered flitch before it is mounted on the staylog (3) may be excavated by means of a series of dado blades that have been arranged in such a way as to cut the dados in one upward plunge cut into the flat underside of the tapered flitch. The positioning of the resulting dados along the underside of the tapered flitch correspond to the position of the wedge-clamp dogs (1) on the mounting surface (2) of the rotary staylog (3). Referring now to FIGS. 16-17, a typical dado machine (210) consists of a steel framework (212) that is designed to support the dado mechanism. The dado mechanism consists of seventeen sets of dados (214) mounted on a shaft (216) which is motor driven (218). The whole dado mechanism is further attached to the steel framework (212) by means of two ball feed screws (220) which also serve to raise the dado cutters (214) up into the underside of the flitch being processed. The steel framework (212) also serves to support the suspended flitch carriage (222) from which the flitch is positioned and clamped. The flitch carriage (222) consists of a steel bed (224) to which two ball feed screws (220) are attached. Each ball feed screw (220) attaches to and serves to engage the end clamp plates (226) into the two ends of the flitch. The end clamp plates (226) are equipped with cup screws (228) with which to penetrate the ends of the flitch and act to secure the flitch to the flitch carriage. The cup screw (228) exposed heads are designed to penetrate the flitch ends and prevent movement. The cup screw (228) consists of a bolt whose head is round (as opposed to hexagonal or square) and is milled so that the outer perimeter takes on a knife edge of approximately 21° bevel. This shape has proven to be exceptional in its holding power as it has no tendancy to split the wood.

The flitch to be dadoed is positioned so that it will be centered from side to side as it relates to the dado blades. The flitch is then elevated by means of lifting plates (230) which are attached to ball feed screws (220) until its top surface or that from which the first sheets of veneer are to be cut from makes contact with the flitch carriage. Once contact has been made from both ends of the flitch, the clamp plates (232) ball feed screws (220) cause the clamp plates (232) to move toward and engage the two ends of the flitch thus pinching the flitch between the two clamp plates. The position of the flitch carriage is controlled by means of two ball feed screws (220)—one at each end of the carriage. The positioning is further aided by computer so that the flitch is moved to the point where it is positioned directly over the dado cutters (214). In so doing, the dado cuts are centered (from side to side) on the flitch and therefore causes the flitch to be centered (in relation to its heart) when placed on the wedge-clamp dogs (1) on the staylog rotary (3). The depth of the dados (234) in the flat underside of the tapered flitch can vary from no depth of engagement on the small end to as much as 3 inches on the butt end of the flitch. The depth adjustment can be done by the operator or automatically by computer when the lifting plates (230) first press the flitch into the flitch carriage. The computer can take note of the lifting plates position and, with the desired depth programmed in, cause the dado cutters (214) to move up into the flitch to the desired depth. Once the flitch is dadoed, the ball feed screws (220) of the flitch carriage (222) cause the flitch carriage (222) to carry the completed flitch to a point where it can be sent to the wedge-clamp dogs on the rotary staylog (3) for slicing. The dado machine (210) is designed to be capable of cycling a flitch in less than 90 seconds.

Experimentation has shown that when the flitch has at least one inch of taper it is unnecessary to engage the small end at all—that is the flitch is held securely enough by the deeper (1 inch or more) dados on the butt end to more than adequately hold the top end of the flitch. This feature thus permits the operator to cut veneer from the flitch to the point where there is virtually no core at the small end of the flitch. Yields do increase as a result.

Figure 5:
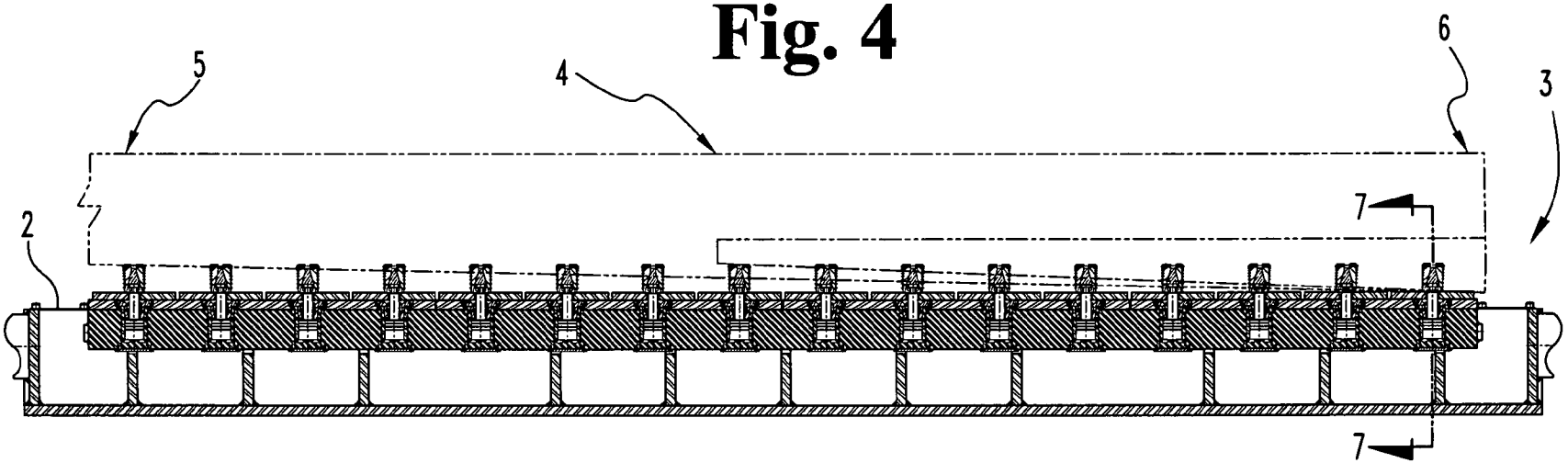
FIG. 5 is a left side sectional view of the wedge-clamp rotary staylog of FIG. 4 taken along line 5-5.

Once the tapered flitch has been prepared for mounting on the rotary staylog (3) in the manner described above, the tapered flitch is lowered onto the wedge-clamp dogs (1) on the mounting surface (2) of the rotary staylog (3) until the dado pockets have bottomed out on the tops of the wedge-clamp dogs (1). As illustrated in FIG. 5 the flitch does not lie flush against the mounting surface (2) of the rotary staylog (3) unless the dado pockets have bottomed out on the tops of the wedge-clamp dogs (1) to the maximum allowable depth. Even then the contact with the mounting surface (2) serves no purpose. The tapered flitch does not and further need not lie flush against that mounting surface (2) of the staylog (3) as would a conventionally prepared flitch mounted on a rotary staylog of the prior art. However, the top curved surface of the tapered flitch (4) is level from the small end (5) to the butt end (6), and thus the veneer producing face of the naturally tapered flitch is in a substantially parallel relationship with the mounting surface (2) and thus the veneer slicing knife. The tapered flitch (4) is held stable in this position when hydraulic cylinders (7) are activated and the wedge-clamp dogs (1) that are attached to the hydraulic cylinders (7) expand within the dados in the tapered flitch to thereby secure the tapered flitch in place on the rotary-staylog (3).

Figure 9:
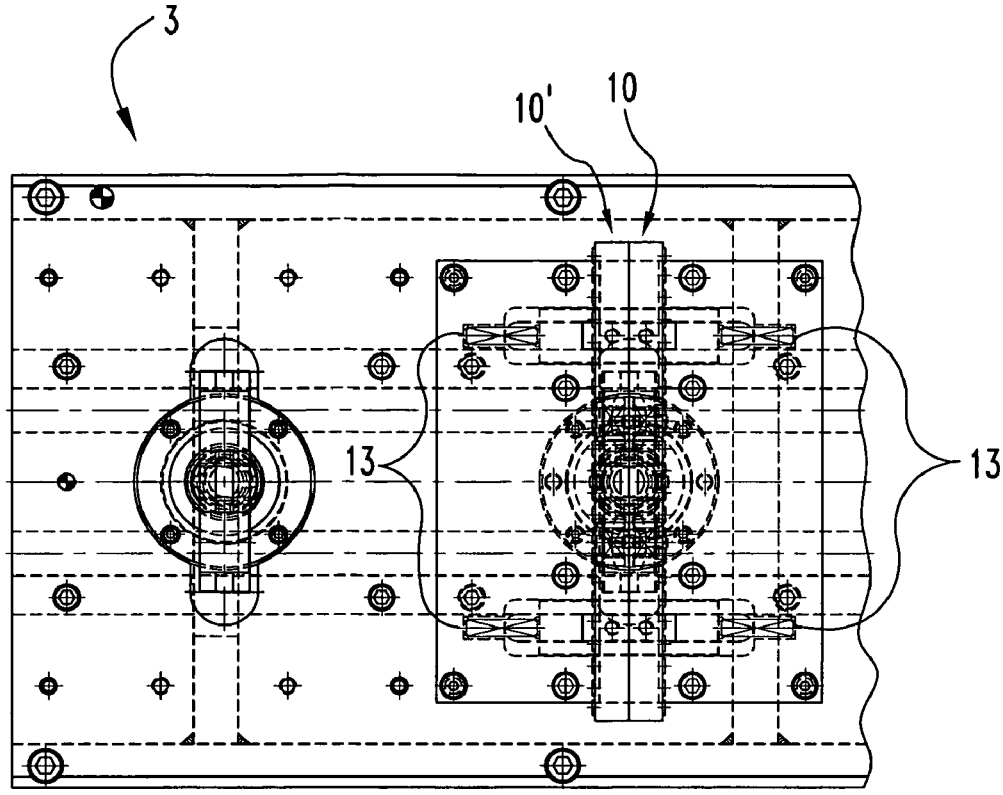
FIG. 9 is an enlarged sectional top plan view of the wedge-clamp dogging rotary staylog of FIG. 4.
Figure 10:
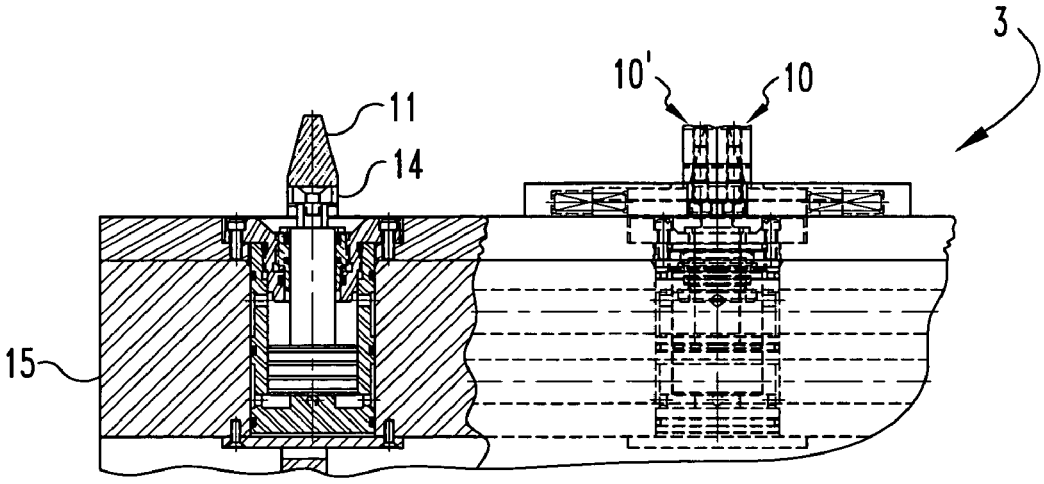
FIG. 10 is a partial sectional side view of FIG. 9 taken along line 10-10.

Referring now to FIGS. 9-10, in the preferred embodiment to date of the wedge-clamp dogging rotary staylog (3) of the present invention, each wedge-clamp dog (1) includes a right and left hand clamp plate (10, 10') which are kept in relative position to each other by means of two bolt-mounted springs (8) located as close to the tops of the clamp plates (10, 10') as the cup screw holding devices (9) will allow. These springs (8) act to return the clamp plates (10, 10') to their original collapsed position when the hydraulically activated wedge (11) is retracted, thus disengaging the cup screws (9) from the dados and allowing the flitch core to be removed. The clamp plates (10, 10') are secured to the mounting surface (2) of the staylog (3) by means of two "T" bolts (12) per clamp plate (10, 10'). The "T" bolts (12) are made of bronze aluminum to prevent gaulding and are bolted into the bottom of the clamp plates (10, 10') and slide in slots provided in the mounting surface of the staylog. At the "T" bolt slots (12) ends, the mounting plate is further milled out to allow for die springs (13) to be placed. The die springs (13) serve to force the clamp plates (10, 10') back into the disengaged position when the bronze aluminum wedges (11) are hydraulically retracted, thereby causing the cup screws (9) to disengage from the flitch core thereby permitting the flitch cores removal from the staylog (3). The bronze-aluminum wedges (11) are positioned between the right and left hand clamp plates (10, 10') whose inner surfaces are configured to relate to the wedge's degree of slope. The clamp plates (10, 10') are further connected to the hydraulic cylinder rod by means of a "T" slot connection (14), which prevents the cylinder rod from being placed in a bind, that is, by being able to shift slightly from side to side as opposed to a threaded connection, the cylinder is prevented from getting in a bind. The hydraulic cylinders (7) are hydraulically powered and controlled by conventional means. The hydraulic cylinders (7) are contained in a solid steel manifold (15) which virtually eliminates hydraulic hoses and fittings—the hoses and fittings being supplanted by two gun bored holes (16) which intercept the cylinders (7) and thus supply the hydraulic pressures needed to activate or deactivate the pistons.

When the piston of the hydraulic cylinder moves upwardly, the bronze aluminum wedge (14) moves upwardly between the left and right hand clamp plate (10, 10'). The clamp plates (10) expand outwardly and contact the dado sides with even pressure from top to bottom and side to side of the dado. On the most preferred embodiment of the wedge-clamp to dato, cup screws (9) are arranged around the outer perimeter of each clamp plate (10, 10') face providing additional grip between the clamp plate faces (10, 10') and the dado pockets. The cup screw (9) consists of a screw with a ⅜" diameter round head (as opposed to a hexagonal or square headed screw) that is milled so that its outer perimeter takes on a knife edge of approximately 30° bevel. Alternatively, the clamp plate faces could be milled to provide a gripping surface such as: knurling, file surface, turned knife edge rings, etc. These surfaces could be used alone or in conjunction with the cup screws.

The tapered flitch, as it is positioned on the rotary-staylog (3) relative to the veneer cutting knife, has its entire curved outer face from which the veneer will be cut substantially parallel to the veneer cutting knife's edge. When the knife advances toward the spinning tapered flitch and first engages the flitch, the knife will be cutting the entire length of the tapered flitch due to the fact that the entire length of curved outer surface of the tapered flitch is aligned with the veneer cutting knife. The veneer cutting knife cuts along the entire length of the tapered flitch from the very first cut and from the very first veneer sheet produced thereby. This is in contrast to the prior art methods of attaching squared up flitches flush with the mounting surface of the staylog, where due to saw runout or intentional sawing in preparing the veneer logs only the butt end of the squared up flitch engages the veneer cutting knife for many of the first cuts of the knife and many of the first sheets produced thereby. This results in short-tapered sheets of veneer with low value and high production costs. These tapered sheet bundles can include 50 sheets or more.

Figure 8:
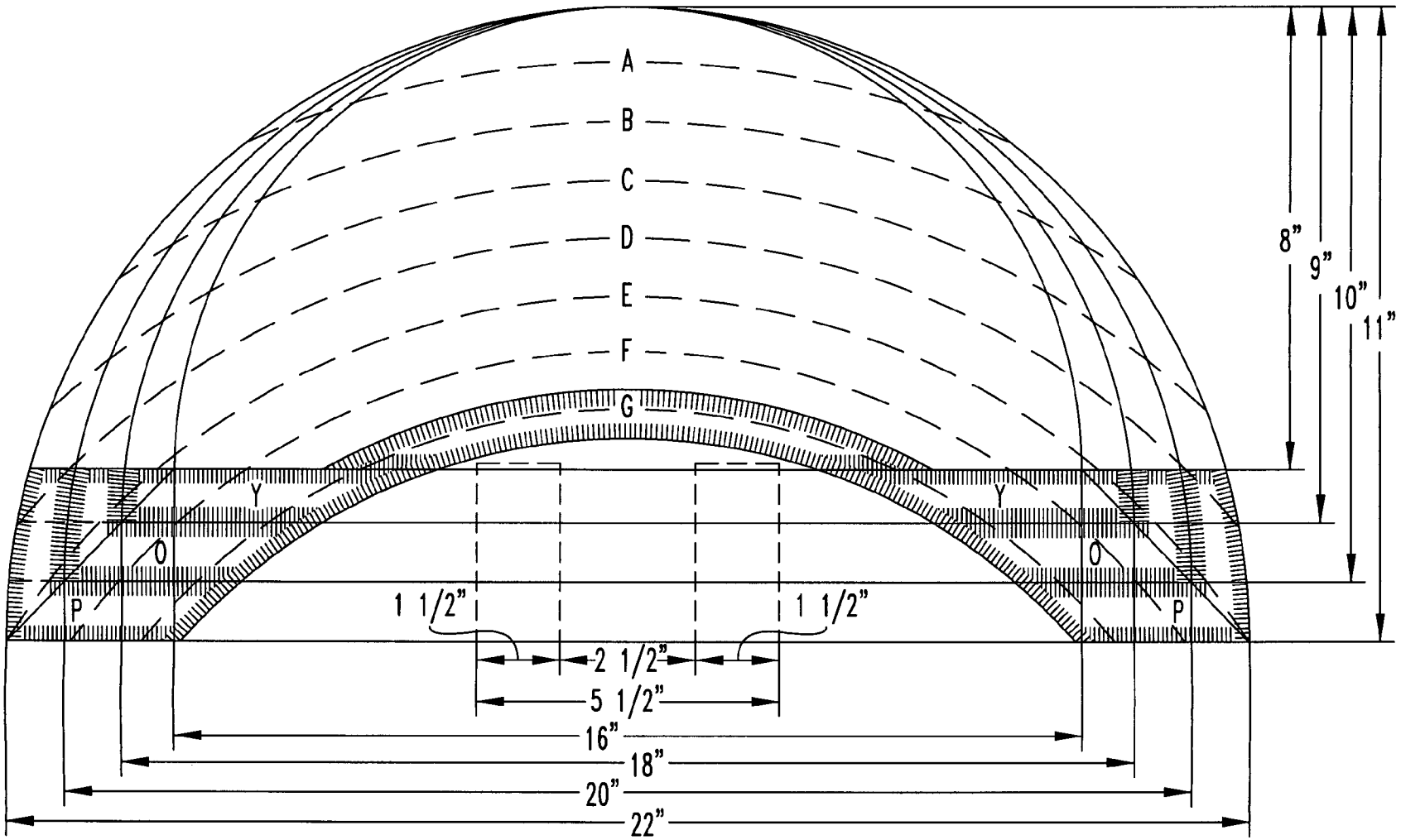
FIG. 8 is a veneer yield diagram illustrating veneer yield increases.

The first several dozen sheets coming off a tapered flitch utilizing the method and apparatus of the present invention are of more value than would have been obtained utilizing the methods and apparatus of the prior art, because they are of full flitch length and are thereby more useful to more customers for their lengths do not restrict their uses. Referring now to FIG. 8, these sheets would be represented by those sliced from a tapered flitch from the top down to slice A in FIG. 8.

The sheets sliced from slice A down to approximately half way between slice C and slice D would be very close in size and quality to those cut by the traditional methods of the prior art. However, from midway between slice C and slice D and on throughout the tapered flitch, the width of the butt end of the sheets would be increased as is shown by the dotted lines representing slices D, E, F, and G from where they extend below the line which represents the point 8 inches below the top of the tapered flitch. The entire width gained below the 8 inch line is due to the retention of the veneer logs natural taper. The gain in sheet width depends on the extent of the taper. The lines below the 8 inch line represent the butt end of a tapered flitch with a 1 inch taper, a 2 inch taper, and a 3 inch taper. The solid arced line between dotted lines F and G represents the last sheet that could be recovered from a squared up flitch that is being sliced on a machine of the prior art. The areas between that solid arced line and the solid arced line below the dotted line represents the additional veneer recoverable due to the ability to reduce the required depth of engagement of the wedge-clamp dogs in relation to the small end of the tapered flitch. The shallower depth of engagement is due to the strength that is obtained by having the depth of the dados cut in the tapered flitch grow progressively deeper as they extend toward the butt of the veneer log, according to the method of the present invention.

Referring now to FIG. 7 a novel means of informing the staylog operator that the wedge-clamps will strike the veneer knifes edge within a few more revolutions of the rotary staylog is illustrated in FIG. 7. The tops of the wedge-clamps (10, 10') have had the top 75 thousandths milled off giving the clamp plates a flat surface approximately 3 inches long (17). Because the clamp plate's radius is 7 inches and the cutting radius is always greater than 7 inches, the veneer knife will always intercept the dado cut where the clamp plates have been milled flat and thus a series of 2 inch wide holes will appear in the flitch at 9 inch intervals along its entire length. These holes will serve to notify the staylog-operator that he should cut no further.

The overall quality of the veneer is enhanced in several ways by utilizing the novel method and apparatus of the present invention. The first sheets off the knife are full flitch length, not short and tapered. The heartwood tends to come in along the entire length of the sheets at the same time rather than start at the butt end and slowly work its way up. This enables the user to get valuable full length sheets much sooner than the present methods of veneer cutting.

The first half of the veneer coming off the tapered flitch is generally free of heart defects, but trees do not grow without limbs and sooner or later the knots appear. At about the same time that the knots appear, the butt end of the sheets begins to widen due to the taper being left in the flitch. This additional width not only increases the yield for the veneer producer, but it also allows the end user or export veneer producer the option to clip out the knots by holding to the edge of the sheet. The method of attachment, i.e., wedge-clamps dogging method versus the grooved method, allows the tapered flitch to remain steady through the cut and thereby avoid shim sheets. The stability of cut is also greatly enhanced because the tapered flitch is resting fully on the radiused edges of the wedge-clamps.

The wedge-clamp staylog of the present invention is a much safer machine than staylogs of the prior art including the collet dog staylog described in Miller's U.S. Pat. No. 5,865,232 and also the pin dog staylog and others described in Brand's U.S. Pat. No. 5,868,187. One only has to imagine the dangers involved in a revolving staylog where the flitch is, enough shorter than the capacity that one or more dogs are exposed. Should a worker accidentally brush up against the revolving staylog and make contact with the exposed dog, the worker would most assuredly suffer serious injury if not death. This is especially true in the case of the pin dog, whose annular knife rings are so adept at securing a flitch, but cannot distinguish wood from flesh.

The wedge-clamps safety device is derived from its design. First of all, the wedge-clamps (1) are radiused in a way that prevents the spinning staylog and its dogs from having a square edge to grab at clothing or body parts. Secondly, the grabbing action of the wedge-clamp dogs (1) is achieved by using cup screws (9) that extend only 1/16 inch beyond the clamp plate (10, 10') faces and are used to hold from the ends of the flitch—not the sides. This means that the screw cups (9) will not grab clothing or body parts even when left exposed due to a short flitch being sliced.

The wedge-clamp staylog (3) has features that make it more user friendly in addition to being safer to operate.

Loading/Unloading:

The pin dog and collet dog staylogs of the prior art are difficult to load due to the need to align the flitch with the dogs before it can be lowered completely onto the dogs. The wedge-clamps (1) load quickly without a lot of maneuvering. With the pin dog, it is very difficult to remove the spent core because of the pindog's annular knife rings, which, while very good at holding the flitch on the machine, do not want to let go when you want them to. The wedge-clamp staylog (3), when disengaged, will drop the spent core if it is disengaged while upside down. It does not try to keep holding on.

Stop Cutting Indicator:

With the pin dog staylog, it is difficult to tell when to stop cutting and failing to stop in time results in the pin dog striking the knife and doing damage requiring a knife change and lost knife life due to excessive grinding to remove the damaged edge. The wedge-clamp staylog (3) has a sure-fire indicator, as mentioned earlier. When the dogs become close to the knife, 2-inch wide holes appear in the veneer sheets and the remaining core. The operator has about 3 revolutions to stop cutting before the wedge-clamp dogs (1) will strike the knife. Should the operator fail to stop the machine and the wedge-clamp dogs (1) strike the knife, the strike is more of a glancing blow (due to the curved design of the wedge-clamp dog) and the resulting knife damage is much less than in the case of the pin dog staylog.

Cutter Reliability—Drill Bits Versus Dado Cutters

Both the pin dog staylog and the collet dog staylog of the prior art require the use of drills to create the excavation holes for the prior art dogs to fit into. This requires that all the drill bits be mounted into the drills at exactly the same depth, otherwise the hole bottoms would not be on the same plane with each other, and the dogs would therefore not all bottom out resulting in inferior stability. Further, should a drill bit break, the whole operation stops. The wedge-clamp staylog (3) requires dado sets to cut the excavations for the wedge-clamp dogs (1). The veneer industry has been using 14 inch diameter dados to cut the parallel prior art channels in the flitches with which to dog flitches for decades. The dados are reliable, and while they might dull down, they do not break. Furthermore, with seventeen or more sets of dados doing the cutting, the dados will stay sharp for a very long period of time; therefore there is small chance that there will be lost production due to the dado cutters.

Shim Sheets:

The methods of the prior art required that two parallel channels be cut into the underside of the flitch to allow prior art dogs to attach the flitch to the staylog. These 1 inch deep channels cause the flitch to move when the veneer cores become thin as the veneer is being sliced off toward the core. This instability lets the flitch shy away from the cut, and shim sheets result.

The wedge-clamp staylog (3) requires that dado cuts be provided in which to insert the wedge-clamp dogs (1), however, the dado cuts are perpendicular to the flitch's length. These dado cuts have proven to have no adverse affect on the stability of the flitch. There is no shimming as a result of their superior stability.

The Wedge-Clamp System as it Pertains to Vertical Slicers

Figure 11:
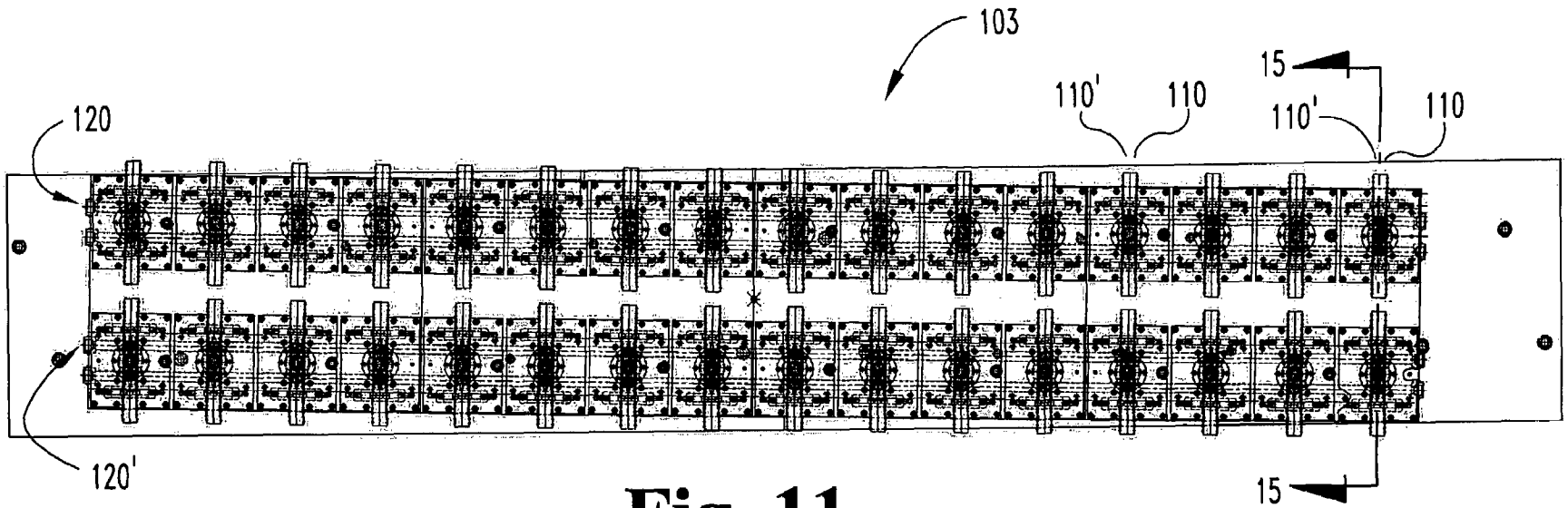
FIG. 11 is a top plan view of a vertical reciprocating slicer of the present invention.
Figure 12:
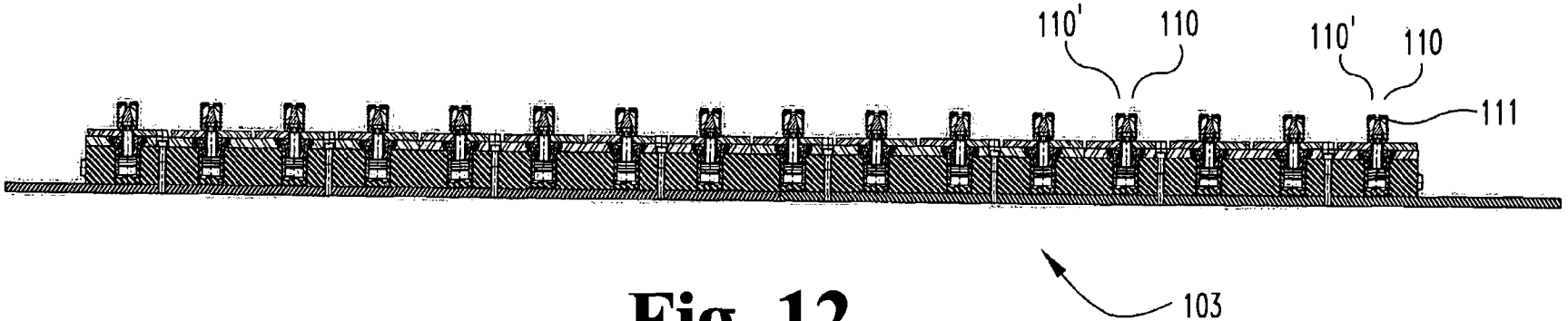
FIG. 12 is a front left side sectional view of the slicer of FIG. 12, taken along line 13-13.
Figure 13:
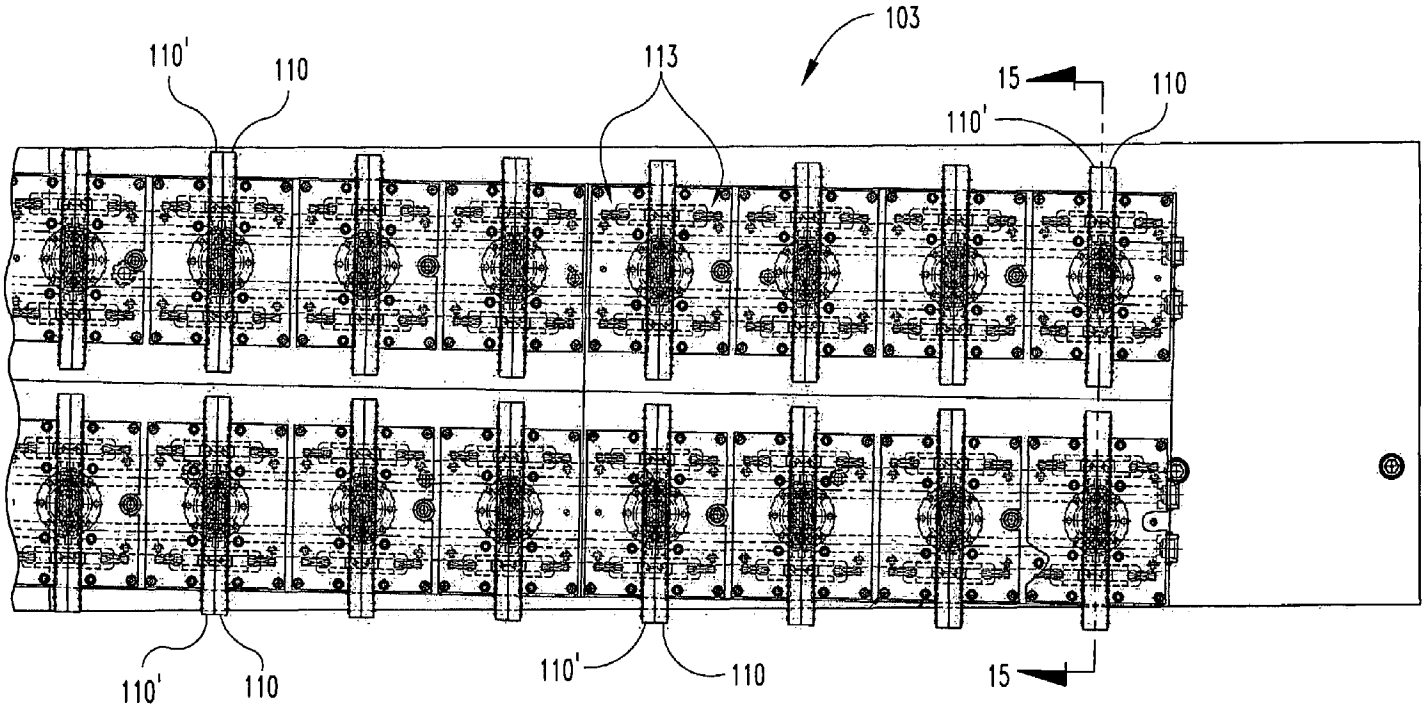
FIG. 13 is an enlarged sectional top plan view of the slicer of FIG. 12.
Figure 14:
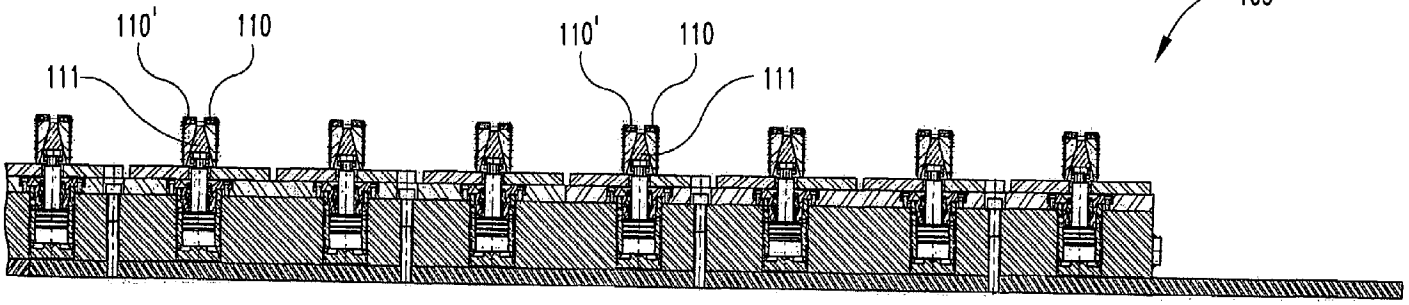
FIG. 14 is an enlarged partial left side sectional view of the slicer of FIG. 12 taken along line 13-13.
Figure 15:
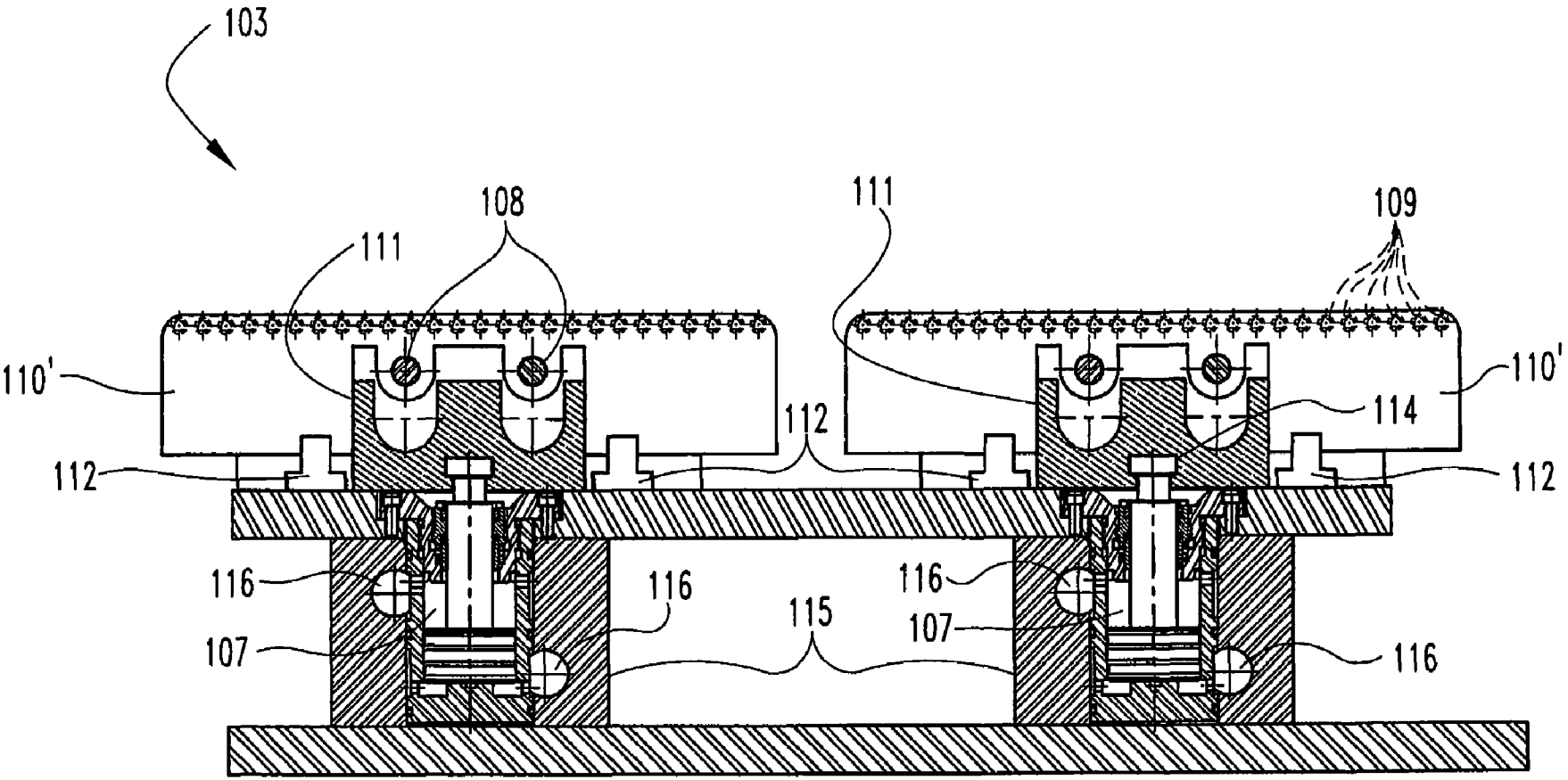
FIG. 15 is an enlarged sectional end view of the slicer of FIG. 4 taken along line 16-16.

Referring now to FIGS. 11-15, modifying the wedge clamp dogs of the rotary staylog (3) to adapt them to vertical reciprocating slicers (103) requires very little effort. The hydraulic manifold would be identical as would be the wedges (111) that activate the clamp plates (110, 110'. The hydraulic controls would be the same, however there would be twice the controls for there would be two manifolds per machine—one top and one bottom (120, 120') (FIGS. 11, 13). In FIGS. 11-17, the clamp plates (110, 10') would be different in that whereas the rotary staylog has radiused clamp plates (10, 10'), the vertical slicers clamp plates (110, 110') would be the same height and width, and they are not radiused; they are straight across their tops (FIG. 15). The screw cups (109) are used just as on the rotary wedge-clamps—that is the screw cups (109) are positioned along the straight top edge of the clamp plates (110, 110') (FIG. 15). Two manifolds are used—one top, one bottom—so that the wedges (111) are not expected to do much work—that is, one piston centered on a 28 inch clamp plate would require too much of the piston. By having two manifolds, the clamp plate (110, 110') length is reduced by 50 percent to 14 inches—the same length as the rotary clamp plates (10, 10'). The top manifold would be plumbed separately from the bottom manifold. This allows for the operator to unclamp the bottom set independent of the top set. This independent operation of clamps allows a benefit to be obtained as follows.

It has long been the practice of veneer mills to slice a flitch until the bottom half of the veneer sheets are cutting rough. The sheets cut rough because the knife is cutting against the grain on the bottom half of the flitch. This is common knowledge in the industry and also among woodworkers in general. When the operator determines that the veneer is cutting too rough, the flitch is removed from the flitch table and split in two through the heart by means of a splitting saw. The two halves are then remounted on the slicer, one at a time. The top half is remounted positioned the same as before it came off, i.e., the same side up. The bottom half, however, is turned around so that the bottom side faces up. In this way, the wood will be cut with the grain resulting in smooth veneer. After the top half is sliced, the bottom half is mounted and sliced. This is all very time consuming.

The wedge-clamps (110, 110') will improve the efficiency of the above-described operation. The flitch is prepared for mounting on the dado saw that is used for the rotary staylog, only instead of plunging the dados into the center of the underside of the flitch, the computer driven flitch carrier is put into slicer mode and the flitch is moved across the extended dado blades creating dado cuts across the width of the flitch. The depth of the dado cuts would be determined just as they are in the rotary staylog application. Next the flitch carriage would move the flitch past the dados to the ripping saw position where a 24 inch diameter circular saw is prepared to "pre-split" the flitch. That is, the dado saw operator predetermines the depth to which the flitch is to be pre-split based on how the flitches have been cutting and then has the flitch split to that depth leaving the flitch still in one piece. The flitch is mounted on the slicer (103) so that the top manifold (120) wedge clamp dogs (110, 110') clamp the flitch above the pre-split and the bottom manifold (120') wedge clamp dogs (110, 110') clamp the flitch below the pre-split. To help position the flitch so that the flitch is properly positioned, a ¼ inch thick fin runs the length of the flitch table separating the top wedge clamp dogs (110, 110') from the bottom set. The fin is 3 inches tall and therefore extends the same distance out from the flitch table as the clamp plates. The flitch is mounted on the flitch table with the ¼ inch fin inserted in the pre-split channel. The wedge clamp dogs (110, 110') are activated, the flitch is sliced until the pre-split causes the veneer sheet to be cut in two. The slicer (103) is then stopped, the bottom half of the flitch—that which is going to cut rough—is chained to a hoist and the bottom manifold (120') is deactivated, causing the wedge clamp dogs (110, 110') to retract. The half flitch is then removed from the machine, rehung from the hoist so that the bottom side is now up and returned to the machine where it is repositioned on the bottom manifold (120') wedge clamp dogs (110, 110') and reclamped. The operator then commences slicing both halves at the same time—at a slower rate of speed to allow for catching the sheets.

The logs for the slicer are to be prepared the same as for the rotary—that is mill to the outside of the log keeping all of the taper possible and then splitting the log to create two flitches which are thicker at the butt end than the top end. The dado cuts on the underside of the flitch would be made to go all the way across rather than a plunge cut as on the rotary system. However, the depth of cut will be figured the same as the rotary—that is as long as there is one inch of taper do not let the dado engage on the small end. The strength derived from the deeper dados on the butt end more than makes up for the shallow dado cuts on the small end of the flitch. The flitch can be sliced to the point where the next cut will hit the wedge clamp dogs (110, 110') without encountering any shim sheets.

When slicing flitches on a vertical slicer using the prior art (hydraulic dogs grasping from the top and bottom of the flitch) as the flitch becomes thinner due to removing veneer sheets, the pressure from the hydraulic dogs cause the flitch to flex outward in the middle causing thickness problems, i.e., both thick and thin. The thin sheets are shims and are either thrown out by the offbearers or left in the flitch to become a source of aggravation or concern for the end user. With the wedge-clamp dog system, the flitch will not flex when the flitch gets thin because the wedge clamp dogs (110, 110') will not allow that sort of flexing or flexing of any kind. There are no shim sheets.

Presently, a prior art method of attachment, the vacuum flitch table, has found favor with the industry. The vacuum flitch table uses a vacuum to hold the flitch on the slicer but the flitch must first be planed so as to be flat. The planing process removes valuable wood from the flitch, but the vacuum tables allows the operator to cut down to nearly ¼ inch before he must stop. It is believed that the vacuum flitch table increases yield by six percent—a good gain. The wedge clamp dogs (110, 110') will exceed the gains of the vacuum flitch table by at least three fold (i.e., 18 percent). This is accomplished as follows. The flitch is not planed; it is just dadoed. The flitch is not dadoed all the way to the small end as long as there is at least 1 inch of taper in the flitch. The flitch is mounted to the wedge clamp dogs (110, 110') flitch table and sliced down to the wedge clamp. In this manner, the flitch is being sliced to the point where there is no backing board left (i.e., the part of the flitch left for dogging purposes) but rather, more of the flitch is sliced than with either of the prior art methods of attachment because there is slicing past what was the last of the prior art backing board.

The splitting saw allows for a stop cut warning. This is accomplished by pre-splitting the flitch for a slicer to a depth slightly deeper than the dado cuts (approximately 75/1000), which is about three veneer sheets. Then, as the operator slices through the flitch to the point where the veneer sheet is split in two, he knows that he must stop to avoid hitting the dogs.

We claim:

1. A method for retaining a flitch on a staylog for slicing veneer from the flitch, the staylog having a plurality of expandable wedge-clamp dogs, comprising the steps of providing a flitch having a plurality of dados perpendicular to the length of the flitch for receiving a plurality of wedge-clamp dogs that are arranged perpendicular to the length of the staylog, wherein each wedge-clamp dog includes a wedge, which when activated causes a right and left hand clamp plate to expand;

positioning the plurality of wedge-clamp dogs within the plurality of dados in the flitch; and expanding the right and left hand clamp plate of each wedge-clamp dog with the wedge to secure the flitch to the staylog.

2. The method of claim 1 wherein the expanding step includes means for hydraulically actuating expanding the clamp plates of each wedge-clamp dogs to secure the flitch to the staylog.

3. The method of claim 2 wherein the expanding step further includes cup screws on the outer surfaces of the clamp plates of each wedge-clamp dogs that engage the flitch to secure the flitch to the staylog.

4. The method of claim 3 wherein the expanding step further includes a hydraulically driven wedge that expands the clamp plates of each wedge-clamp dogs to secure the flitch to the staylog.

5. A method of retaining a flitch on a staylog for slicing veneer from the flitch, the staylog having a plurality of wedge-clamp dogs, comprising the steps of providing a flitch having a plurality of dados perpendicular to the length of the flitch for receiving the plurality of wedge-clamp dogs, the dados having a depth profile and the wedge-clamp dogs having flitch engaging portions configured to generally conform to the depth profile arranged perpendicular to the length of the staylog;

positioning the plurality of wedge-clamp dogs in the plurality of dados; and engaging the flitch with the wedge-clamp dogs to retain the flitch on the staylog with a veneer producing zone maintained in parallel relation to a veneer slicing knife.

6. The method of claim 5 wherein the engaging step includes means for hydraulically expanding the wedge-clamp dogs to retain the flitch on the staylog.

7. The method of claim 6 wherein the engaging step further includes cup screws on the surfaces of the wedge-clamp dogs that engage the flitch to retain the flitch on the staylog.

8. The method of claim 7 wherein the engaging step further includes a hydraulically driven wedge that expands the wedge-camp dogs to retain the flitch on the staylog.

9. An apparatus for retaining a flitch on a staylog, the flitch including a plurality of dados formed in the flat underside surface thereof, comprising:

a staylog for carrying a flitch;

a plurality of wedge-clamp dogs that are arranged perpendicular to the length of the staylog attached to the staylog and positioned to be received by a plurality of dados arranged side-to-side in the flat underside of a flitch for engaging the flitch, and means for expanding the wedge-clamp dogs when engaged with a flitch to hold the flitch on the staylog.

10. The apparatus of claim 9 wherein the means for expanding includes a hydraulically driven wedge that expands the wedge-clamp dogs to retain the flitch on the staylog.

11. The apparatus of claim 10 wherein the means for expanding further includes cup screws on the surfaces of the wedge-clamp dogs that engage the flitch to retain the flitch on the staylog.

12. The apparatus of claim 11 wherein the wedge-clamp dogs further include a hydraulically driven wedge that expands the wedge-clamp dogs to retain the flitch on the staylog.

13. An apparatus for retaining a flitch for slicing, comprising:

a staylog having a mounting surface with a plurality of predetermined positions, and a plurality of wedge-clamp dogs located at the predetermined positions for engaging the flitch to retain the flitch on the staylog that are arranged perpendicular to the length of the staylog, wherein the distance between the mounting surface and the flitch at a predetermined position is proportional to the thickness of the flitch at the predetermined position.

14. The apparatus of claim 13 wherein the wedge-clamp dogs further include cup screws on the surfaces of the wedge-clamp dogs that engage the flitch to retain the flitch on the staylog.

* * * * *

UNITED STATES PATENT AND TRADEMARK OFFICE

CERTIFICATE OF CORRECTION

PATENT NO. : 7,552,750 B2
APPLICATION NO. : 11/107026
DATED : June 30, 2009
INVENTOR(S) : Miller et al.

It is certified that error appears in the above-identified patent and that said Letters Patent is hereby corrected as shown below:

Column 11 line 10, delete "(110,10')" and insert in lieu thereof --(110,110')--.

Signed and Sealed this

Eighth Day of September, 2009

David J. Kappos

David J. Kappos
*Director of the United States Patent and Trademark Office*